United States Patent [19]

Koishi et al.

[11] Patent Number: 4,835,082

[45] Date of Patent: May 30, 1989

[54] TONER FOR ELECTROPHOTOGRAPHY

[75] Inventors: Masumi Koishi, Sagamihara; Manabu Sawada, Kyobashi; Nobuyuki Igarashi, Kyobashi; Akira Arikawa, Kyobashi, all of Japan

[73] Assignee: Toyo Ink Manufacturing Co., Ltd., Tokyo, Japan

[21] Appl. No.: 20,585

[22] Filed: Mar. 2, 1987

[30] Foreign Application Priority Data

Mar. 7, 1986 [JP] Japan ..... 61-48268

[51] Int. Cl.[4] ..... G03G 9/08

[52] U.S. Cl. ..... 430/109; 430/137

[58] Field of Search ..... 430/109, 110, 137

[56] References Cited

U.S. PATENT DOCUMENTS

| | | | |
|---|---|---|---|
| 3,196,032 | 7/1965 | Seymour | 117/16 |
| 4,107,062 | 8/1978 | Tomono et al. | 430/109 |
| 4,189,390 | 2/1980 | Noguchi et al. | 430/111 |
| 4,533,614 | 8/1985 | Fukumoto et al. | 430/109 |

FOREIGN PATENT DOCUMENTS

| | | |
|---|---|---|
| 1937651 | 7/1969 | Fed. Rep. of Germany . |
| 2518274 | 12/1982 | France . |
| 58-68048 | 4/1983 | Japan . |
| 58-42057 | 11/1983 | Japan . |
| 59-101654 | 12/1984 | Japan . |

*Primary Examiner*—John L. Goodrow

*Attorney, Agent, or Firm*—Bucknam and Archer

[57] ABSTRACT

A toner for electrophotographs which is prepared by mixing thermoplastic resin core particles (A) having an average size of from 1 to 15 μm with a colorant (B) and without or together with at least one of additives in a finely particulate form while applying mechanical strain force to the whole under such conditions that the average size of the resulting toner particles is in the range of 1–20 μm whereby the colorant (B) and the other necessary fine particles are embedded substantially as primary particles in the resin core particles (A). A process for production of the toner is also disclosed.

13 Claims, No Drawings

TONER FOR ELECTROPHOTOGRAPHY

BACKGROUND OF THE INVENTION

1. Field of the Invention

This invention relates to toners used for the dry development of an electrostatic latent image in an electrophotograph.

2. Description of the Prior Art

There have heretofore been known several dry developing methods including a method using a two-component developer composed of toner particles mixed with carrier particles such as glass beads or magnetic powder, and a method using a one-component toner composed of toner particles imparted with magnetism. Recently, there has been proposed a method using a one-component nonmagnetic toner which is excellent in environment resistance.

These toners have been, in most cases, prepared by mixing, heating and melting thermoplastic resins, colorants such as pigments or dyes and additives such as wax, plasticizers, charge-controlling agents and the like; kneading the pigments in the form of secondary agglomeration under the application of intense shearing force thereto; uniformly dispersing, if necessary, magnetic powder to the mixture to obtain a uniform composition; cooling and comminuting the composition; and then classifying the resulting particles to obtain desired toner particles.

However, the toner particles so obtained are qualitatively disadvantageous in that they are not uniform in size and shape and are generally amorphous, so that the individual particles have different frictional charging characteristics, thus causing their staining or scattering within a machine concerned. In addition, the toner particles have so low flowability that it becomes difficult to supply them smoothly with many troubles being undesirably involved. On the other hand, from the standpoint of a process for the production thereof, there are several problems that much energy is required for the kneading step and that the classification undesirably needs a number of processing steps.

To avoid this, there have been proposed attempts to obtain spherical toners by a spray drying or suspension polymerization process. However, the former process requires proper selection of resins which are soluble in a solution and presents a problem as to an offset phenomenon on fixing drum. The latter process raises problems as to blocking and offset phenomena and is therefore not industrially used.

Conventional toners have the common disadvantage that a colorant and a charge controlling agent, which exhibit their characteristic properties on the toner surface and are relatively expensive as starting materials for the toners, are uneconomically contained not only in the surface portion of the toner but also in the inside thereof.

SUMMARY OF THE INVENTION

It is accordingly an object of the invention to provide a toner which can solve the problems of the prior art.

It is another object of the invention to provide a toner which has a relatively round shape or is in a sharp edge-removed state and has a relatively uniform particle size whereby the toner particles exhibit good flowability and good frictional charging characteristics.

It is a further object of the invention to provide a toner which is economically advantageous and can be prepared in a simpler manner than known counterparts.

It is a still further object of the invention to provide a process for production of the toner as mentioned above.

The above objects can be achieved, according to the invention, by the provision of a toner for electrophotographs which is prepared by mixing thermoplastic resin core particles (A) and a colorant (B) without or together with at least one of additives in a finely particulate form while applying mechanical strain force to the whole under such conditions that the average size of the resulting toner particles is in the range of 1–20 μm (micron meters) whereby the colorant (B) and the other fine particles are embedded substantially as primary particles in the resin core particles (A). It will be noted that the particle size used herein is intended to mean a particle size which is determined by the use of Coulter Counter Model TA II (made by Coulter Electronics Co., Ltd.) and is indicated on the volume basis.

DETAILED DESCRIPTION AND PREFERRED EMBODIMENTS OF THE INVENTION

The resins used in the present invention as the core particles may be any known binder resins which include polystyrene; polystyrene copolymer resins of styrene and an acrylic ester, methacrylic ester, acrylonitrile, maleic ester or the like; polyacrylic ester resins; polymethacrylic ester resins; polyester resins; polyamide resins; polyvinyl acetate resins; epoxy resins; phenolic resins; hydrocarbon resins; petroleum resins; and chlorinated Paraffins. These resins may be used singly or in combination.

The thermoplastic resin core particles (A) having an average size of from 1 to 15 μm may be made by any known suitable techniques without particular limitation. For instance, such core particles may be made by a variety of methods including (1) comminution and classification, (2) suspension polymerization, (3) dissolution and precipitation and (4) spraying. Depending on the purpose of the resulting toner, the thermoplastic resin core particles (A) may be used together with various additives including not only magnetic powder described hereinafter, but also lubricants such as wax, flowability-imparting agents such as colloidal silica, charge controlling agents and low molecular weight polyolefins. If these additives are in the form of fine particles, they may be embedded in the core particles according to the same procedure as in the colorant (B). In this case, the embedding procedure may be effected simultaneously with the embedding of the colorant (B), or prior to or after the embedding of the colorant (B). The thermoplastic resin core particles (A) should preferably be, as will be described hereinafter, substantially free of particles having 25 μm or over because such particles are not favorable.

The colorant (B) is not particularly limited but may be any one of a variety of pigments and dyes. Although not intended to limit to those indicated below, typical of the colorants are the following:

Yellow pigments and dyes:

Zinc yellow, yellow iron oxide, Hansa yellow, disazo yellow, quinoline yellow and Permanent yellow.

Red pigments and dyes:

Red oxide, Permanent red, Lithol red, pyrazolone red, Ca salt of Watchung red, Mn salt of Watchung red, Lake red C, Lake red D, Brilliant carmine 6B and Brilliant carmine 3B.

Blue pigments and dyes:

Prussian blue, phthalocyanine blue and metal-free phthalocyanine.

Other orange-, purple- and green-colored pigments, and white or black pigments or dyes such as titanium oxide, oil black, carbon black and the like, may also be used.

In the practice of the invention, the core particles (A) and the colorant (B) are mixed while applying mechanical strain force to the whole under such conditions that the average size of the resultant toner is in the range of from 1 to 20 μm. Furthermore, the said conditions are those under which the core particles (A) must not be melted together into large lumps, they must not be comminuted into too small particles due to the use of too strong a mechanical strain force, and the colorant (B) is embedded in the form of primary particles in the resin core particles (A) while the colorant (B) is being deposited on the surface of the resin core particles (A). The technique for satisfying the above requirements is, on a laboratory scale, use of a mortar. Industrially, dispersing machines such as grinding mills, ball mills, sand mills and the like, which show the same effect as a mortar, are used in such a way that their operating conditions, the amount of the materials (A) and (B) treated and the dispersion medium used are appropriately controlled so as to meet the above requirements.

However, since the mixing in a mortar takes several hours to several tens of days and that even in a ball mill or a sand mill takes a long time, some types of mixers are used industrially, including a mixer in which powders in a fluidized bed state are moved at a high speed along with an air flow, and a mixer having blades or hammers capable of yielding an impact force. Examples of such mixers include an SI mill (made by Toyo Ink Mfg. Co., Ltd., see Japanese Patent Publication No. 57-43051), an atomizer, a Jiyu mill (made by Nara Kikai Seisakusho K.K.) and a grinding mill, KTM-1, made by Kawasaki Heavy Ind. Co., Ltd. These mixing devices may be used as they are or after modification in conformity with the purpose of the invention. If possible, the mixer should preferably be of a circulating and closed type, typical of which is a Hybridizer (made by Nara Kikai Seisakusho K.K.).

The reason why the colorant (B) is deposited on the core particles (A) simultaneously with being embedded therein as primary particles, is considered due to the fact that the core particles (A) and the colorant (B) are collided with one another and also with the wall, blades and dispersion medium such as beads, whereupon-n they become 1 fairly hot instantaneously and partially, thus bringing about a phenomenon similar to a mechanochemical reaction as in the field of inorganic chemistry. The air flow or stream temperature within the system increases up to approximately a glass transition temperature, Tg, of the resin. In some cases, the system has to be cooled. The above phenomenon will be seen through electron microscopic observations of the mixture of the materials (A) and (B) prior to the treatment which is mere pre-mixing and after the mixing treatment. More particularly, the toner mixture prior to the mixing treatment is in a state where the core particles (A) having a relatively large size distribution and the colorant (B) are partially coagulated. On the other hand, after the treatment, the thermoplastic resin core particles (A) have a smooth surface and the fine particles of the colorant (B) are rarely observed, thus the surface of the colorant particles being covered with a thin layer of the resin. A running test using a duplicating machine reveals that the toner particles are difficult to collapse.

Accordingly, if a charge controlling agent is applied, as will be described hereinafter, in the same manner as the colorant (B), it can be readily deposited in a multilayered state on the surface of the core particles or embedded therein. This permits an effective control using only a small amount of the charge controlling agent. The measurement of particle size distribution after the mixing treatment demonstrates that the average size increases by about 20%.

The colorant (B) embedded in the core particles (A) by the mixing treatment is substantially in the form of primary particles. To be primary particles is recognized by the fact that the resultant toner is almost equal in particulate appearance to that of a toner which has been sufficiently kneaded by prior art methods and that images obtained using the toners of the invention and prior art have a similar color density.

The toner particles obtained after the treatment are observed to contain few particles of small sizes and have a relatively uniform size and they are also found to be round with respect to the edges thereof. In other words, the mixing treatment is considered to adjust the small core particles (A) so that they have a certain fixed size.

Various factors by which the above effects are attained are considered. According to the present inventors' studies, in this case of using the mixer utilizing air flow as mentioned above, the speed of the air flow is the greatest factor and is preferably in the range of several tens to several hundreds m/second.

Once again, in the practice of the invention, the particle size of the toner is in the range of from 1 to 20 μm and should preferably be substantially free of toner particles having a size of 0.5 μm or below and also of 25 μm or over. If toner particles having a size of 0.5 μm or below are contained in large amounts, the flowability deteriorates, thus causing soiling or tinting on the background. If toner particles having a size of 25 μm or over are contained in large amounts, the resultant image becomes rough, reducing the commercial value.

In order to use the toner of the invention as a one-component magnetic toner, a magnetic powder may be pre-mixed with a binder resin, followed by conversion into core particles having an average size of from 1 to 15 μm. Alternatively, a magnetic powder may be embedded in the core particles (A) in the same manner as in the colorant (B). The type of a magnetic powder is not critical, but if the latter method is used, a fine magnetic powder having a size of 1 μm or below, preferably 0.2 μm or below, is used. Examples of the magnetic powder include those powders of known alloys or compounds of iron, zinc, cobalt, nickel, manganese and the like such as various ferrites, magnetite and hematite. These magnetic powders may be classified according to the purpose, or may be subjected to known surface treatments such as a hydrophobic treatment and a silane-coupling treatment.

The charge-controlling agents used in the present invention are known per se and include dyes and metal-containing dyes such as Fat Schwarz HBN, nigrosine base, Brilliant Schwarz, Zapon Schwarz X and Ceres Schwarz RG, dyes such as C.I. solvent blacks 1, 2, 3, 5, 7, C.I. acid blacks 123, 22, 23, 28, 42, 43, oil black (C.I. 26150) and Spilon black (trade name of Hodogaya Chemical Co., Ltd.), metal naphthenates, fatty acid metallic soaps, and the like.

Since the charge controlling agent has the purpose of controlling a surface charge of a toner, it is preferably deposited on or embedded in the toner particles (A) along with or after mixing treatment of the colorant (B).

The present invention will be more particularly described by way of examples, in which parts are by weight.

EXAMPLE 1

88 parts of a styrene-acrylic resin (commercial name of Hymer SBM-73, made by Sanyo Kasei K.K.), 4 parts of a charge controlling agent (commercial name of Bontron S-34, made by Orient Chem. Co., Ltd.), and 3 parts of low molecular weight polypropylene (commercial name of Viscol 550P, made by Sanyo Kasei K.K.) were pre-mixed in a Henschell mixer, thereafter melted, kneaded in a biaxial extruder and then followed by allowing to cool. The mixture so obtained was crushed and then comminuted by means of an I-type jet mill to provide core particles (A1) having an upper size of 25 μm or below and an average size of about 10 μm.

100 parts of the core particles (A1) and 5 parts of carbon black were pre-mixed in a super mixer at 2,500 r.p.m. for 1 minute, thereby electrostatically depositing carbon black on the surface of the individual core particles (A1). Thereafter, the carbon black-deposited particles were charged into a free mill M-3 and the number of revolutions in the mill was set at 5,000 r.p.m. The air flow velocity in the free mill was about 90 m/second and an average residence time in the Jiyu mill was about 3 seconds. The mixture discharged into a collector as passed seven times in total into the free mill to obtain an intended toner.

The toner particles had an average size of 12 μm and were substantially free of any particles having a size of 5 μm or below and of 25 μm or over, thus not needing any classification.

80 parts of the toner and 720 parts of an iron powder carrier (commercial name of DSP 128B, made by Douwa Iron Powder Co., Ltd.) were mixed under rotation in a ball mill for 1 hour to obtain a two-component developer. This developer was set in a commercially sold duplicator (commercial name of DC-232, made by Mita Ind. Co., Ltd.) and used for duplication of a test chart on an ordinary paper in a continuous running operation.

As a result of the duplication, it was found that the toner exhibited good fixability, charge stability, blocking resistance and offset resistance. According to a running image test in which the toner of the invention was charged into a toner makeup hopper of the duplicator, it was found that 60,000 copies exhibited the same quality as an initial image, thus the toner having a good makeup ability.

EXAMPLE 2

The general procedure of Example 1 was repeated for preparation of core particles (A1) except that any charge controlling agent was added, thereby obtaining core particles (A2). 100 parts of the core particles (A2), 4 parts of carbon black and 2 parts of the same charge controlling agent as used in Example 1 were used in the same manner as in Example 1 to obtain a toner. This toner was tested in the same manner as in Example 1.

The resultant image was clear with very good toner stability, and blocking and offset resistances. The fixability of the toner was found to be slightly lower, which did not give any substantial influence on the duplicated image. Similar results as in Example 1 were obtained in the running test.

EXAMPLE 3

The general procedure of Example 1 was repeated except that a red organic pigment (No. 28 Lionol Red, commercial name of Toyo Ink Mfg. Co., Ltd.) was used instead of carbon black, thereby obtaining a toner. The thus obtained toner was tested in the same manner with good results being obtained. This toner involved no filming phenomenon of the pigment on a photosensitive material as would be frequently experienced in the case of a toner using an organic pigment as a colorant in prior art.

COMPARATIVE EXAMPLE 1

The same starting materials as in Example 3 were used to prepare a toner according to a known method. The respective starting materials were pre-mixed in a Henschell mixer, melted, kneaded in a biaxial extruder and then followed by allowing it to cool. The mixture so obtained was crushed and milled in an I-type jet mill to obtain a toner which had an upper particle size of 25 μm or below and an average size of about 12 μm and in which toner particles having a size of 5 μm or below was removed.

The thus obtained toner was tested in the same manner as in Example 1. As compared with the toner of the invention, the resultant image had slightly thinner spots on a solid portion. According to the running test, the image density lowered at about 5,000 copies. The filming phenomenon of the red pigment on the photosensitive material was observed along with a bridging phenomenon occurring in the makeup hopper.

EXAMPLE 4

53 parts of a styrene-acrylic resin (made by Nippon Carbide Ind. Co., Ltd., commercial name of Nikolite NC-6100), 2 parts of a charge controlling agent (Orient Chem. Co., Ltd., commercial name of Bontron E-81), 3 parts of low molecular weight polypropylene (Sanyo Kasei K.K., commercial name of Viscol 550P) and 40 parts of magnetite (Toda Ind. Co., Ltd., commercial name of EPT-500) were treated in the same manner as in Example 1, thereby obtaining core particles (A3) having an average size of about 10 μm.

98 parts of the core particles (A3) and 2 parts of carbon black were pre-mixed in a super mixer at 2,800 r.p.m. for 1 minute, thereafter introduced into a closed atomizer system in which the revolution speed of a rotary blade provided within the system was 4,500 r.p.m. At that time, the air flow velocity was 80 m/second and the mixture being introduced resided for 30 minutes and then followed by discharge into a cyclone collector to obtain a toner.

The toner had an average size of 12.5 μm and any particles having a size of 5 μm or below and of 25 μm or over were not observed.

200 g of the thus obtained magnetic toner were set in a developing device of a commercially sold duplicating machine (Canon NP-500, commercial name of Canon Inc.) and used for duplicating a test chart on an ordinary paper with a clear copy.

The fixability, charge stability and blocking and offset resistances of the toner were very good. While a toner was supplemented, a running test was continued, with the result that 50,000 copies had the same image quality as an initial image, without observing any bridging phenomenon of the toner.

COMPARATIVE EXAMPLE 2

The same starting materials as in Example 4 were used to obtain a one-component magnetic toner according to a prior art process. The respective starting materials were pre-mixed in a Henschell mixer, melted, kneaded in a biaxial extruder and then followed by allowing it to cool and crushing in a cutting mill. Thereafter, the crushed pieces were finely divided in an I-type jet mill and subjected to the Alpine classifier to remove fine particles 5 μm or below and particles 25 μm or over both in size, thereby obtaining a toner having an average size of 13 μm.

The thus obtained toner was used to conduct a test in the same manner as in Example 4, with the result that the image density lowered at about 10,000 copies with occurrence of soiling on the background. In addition, a bridging phenomenon within the hopper was observed.

EXAMPLE 5

The general procedure of Example 1 was repeated except that a polyester resin (Kao Co., Ltd., commercial name of KTR-2500) was used instead of the styrene-acrylic resin, thereby obtaining a toner. The toner had similar good properties.

As mentioned above, the toner for electrophotographs of this invention is in the form of particles having a round shape and therefore a difficultly collapsible surface. In addition, they are excellent in flowability and charge stability and also exhibit satisfactory properties when subjected to a long-term running test. Further, the toner of this invention is an excellent one which is applicable to such a developing device wherein a one-component non-magnetic toner is originally usable as disclosed in Japanese Patent Publication No. 60-22150.

In addition, the toner is readily prepared by a simple method as compared with a conventional one, this being economically advantageous too.

What is claimed is:

1. A toner for electrophotographs which is prepared by mixing thermoplastic resin core particles (A) having an average size of from 1 to 15 μm with a colorant (B) while applying mechanical strain force, said mechanical strain force being effected using a mixer in which powers in a fluidized bed state are moved at a high speed along with an air flow in the range of several tens to several hundreds m/seconds, whereby the particles do not fuse and the average size of the resulting toner particles is in the range of 1–20 μm whereby the colorant (B) is embedded substantially as primary particles in the resin core particles (A).

2. A toner according to claim 1, wherein the colorant (B) is a pigment.

3. The toner according to claim 1 wherein the toner particles are of essentially round shape.

4. A toner for electrophotographs which is prepared by mixing thermoplastic resin core particles (A) having an average size of from 1 to 15 μm with a colorant (B) and at least one additive in a finely particulate form while applying mechanical strain force, said mechanical strain force being effected using a mixer in which powders in a fluidized bed state are moved at a high speed along with an air flow in the range of several tens to several hundreds m/seconds, whereby the particles do not fuse and the average size of the resulting toner particles is in the range of 1–20 μm whereby the colorant (B) and said additive are embedded substantially as primary particles in the resin core particles (A).

5. A toner according to claim 4, wherein said additive are a magnetic powder, lubricant, flowability-imparting agent, charge controlling agent, low molecular weight polyolefin and a mixture thereof.

6. The toner according to claim 4 wherein the toner particles are of essentially round shape.

7. The process for the production of a toner for electrophotographs which comprises mixing thermoplastic resin core particles (A) having an average size of form 1–15 μm with a colorant (B) while applying mechanical strain force to the materials (A) and (B), said mechanical strain force being effected using a mixer in which powders in a fluidized bed state are moved at a high speed along with an air flow in the range of several tens to several hundreds m/second, whereby the particles do not fuse and the average size of the resulting toner particles is in the range of 1–20 μm whereby the colorant (B) is embedded substantially as primary particles in the resin core particles (A).

8. A process according to claim 7, wherein the colorant (B) is a pigment.

9. The process according to claim 7 wherein the resin is a member selected for the group consisting of polystyrene; a polystyrene copolymer resin of styrene and an acrylic ester, methacrylic ester, acrylonitrile or maleic ester; a polyacrylic ester resin; a polymethacrylic ester resin; a polyester resin; a polyamide resin; a polyvinyl acetate resin; an epoxy resin; a phenolic resin; an hydrocarbon resin; a petroleum resin; a chlorinated paraffin; and mixtures thereof.

10. A process for the production of a toner for electrophotographs which comprises mixing thermoplastic resin core particles (A) having an average size of from 1 to 15 μm with a colorant (B) and a charge controlling agent while applying mechanical strain force to said materials (A) and (B), said mechanical strain force being effected using a mixer in which powders in a fluidized bed state are moved at a high speed along with an air flow in the range of several tens to several hundreds m/second, whereby the particles do not fuse and the average size of the resulting toner particles is in the range of 1–20 μm whereby the colorant (B) is embedded substantially as primary particles in the resin core particles (A).

11. The process according to claim 10 wherein the resin is a member selected from the group consisting of polystyrene; a polystyrene copolymer resin of styrene and an acrylic ester, methacrylic ester, acrylonitrile or maleic ester; a polyacrylic ester resin; a polymethacrylic ester resin; a polyester resin; a polyamide resin; a polyvinyl acetate resin; an epoxy resin; a phenolic resin; an hydrocarbon resin; a petroleum resin; a chlorinated paraffin; and mixtures thereof.

12. The process according to claim 7 wherein cooling is applied during application of said mechanical strain force.

13. The process according to claim 10 wherein cooling is applied during application of said mechanical strain force.

* * * * *